US010900759B2

(12) United States Patent
Nichols

(10) Patent No.: US 10,900,759 B2
(45) Date of Patent: Jan. 26, 2021

(54) DIE ASSEMBLIES FOR FORMING A FIREARM PROJECTILE, METHODS OF UTILIZING THE DIE ASSEMBLIES, AND FIREARM PROJECTILES

(71) Applicant: Environ-Metal, Inc., Sweet Home, OR (US)

(72) Inventor: Robert Charles Nichols, Albany, OR (US)

(73) Assignee: Environ-Metal, Inc., Sweet Home, OR (US)

( * ) Notice: Subject to any disclaimer, the term of this patent is extended or adjusted under 35 U.S.C. 154(b) by 0 days.

(21) Appl. No.: 16/580,328

(22) Filed: Sep. 24, 2019

(65) Prior Publication Data

US 2020/0094319 A1 Mar. 26, 2020

Related U.S. Application Data

(60) Provisional application No. 62/736,695, filed on Sep. 26, 2018.

(51) Int. Cl.
*F42B 33/00* (2006.01)
*F42B 10/44* (2006.01)

(52) U.S. Cl.
CPC ..... *F42B 33/00* (2013.01); *F42B 10/44* (2013.01)

(58) Field of Classification Search
CPC ..... F42B 33/00; F42B 33/001; F42B 10/44; F42B 12/74
USPC ..... 86/54
See application file for complete search history.

(56) References Cited

U.S. PATENT DOCUMENTS 219,840 A * 9/1879 Winchester ..... F42B 12/34 86/54
1,783,261 A * 12/1930 Rousseau ..... B21K 1/025 86/55
2,379,701 A * 7/1945 Friedman ..... B21K 1/025 86/54
2,393,648 A * 1/1946 Martin ..... F42B 12/06 102/519
2,403,032 A * 7/1946 Stevens, Jr. ..... F42B 33/14 86/19
2,411,379 A * 11/1946 Langhammer ..... B30B 11/04 425/78
2,451,488 A * 10/1948 Huntington ..... B21K 1/025 72/481.3
2,654,140 A * 10/1953 Gibbs ..... B21K 1/025 86/55

(Continued)

*Primary Examiner* — Derrick R Morgan
(74) *Attorney, Agent, or Firm* — Dascenzo Gates Intellectual Property Law, P.C.

(57) ABSTRACT

Die assemblies for forming a firearm projectile and methods of utilizing the die assemblies are disclosed herein. The die assemblies include a forming die, a first punch, and a second punch. The forming die defines a first side, a second side that is opposed to the first side, and a die cavity that extends between the first side and the second side. The first punch is configured to seal against the forming die from the first side. The second punch is configured to be received within the die cavity from the second side. When the first punch seals against the forming die and the second punch is received within the die cavity, the first punch, the second punch, and the forming die collectively define a forming surface shaped to define an external contour of the firearm projectile.

27 Claims, 5 Drawing Sheets

(56) References Cited

U.S. PATENT DOCUMENTS 2,958,924 A * 11/1960 Thacker ..... B21K 1/025 86/55
3,157,137 A * 11/1964 Burns, Jr. ..... F42B 12/78 102/509
3,233,304 A * 2/1966 Hettes ..... B21K 1/025 86/54
4,044,685 A * 8/1977 Avcin ..... F42B 12/34 102/508
5,131,123 A * 7/1992 Brooks ..... B21K 1/025 86/54
5,259,320 A * 11/1993 Brooks ..... B21K 1/025 102/501
5,847,313 A * 12/1998 Beal ..... F42B 12/74 102/516
5,943,749 A * 8/1999 Swank ..... B21K 1/025 102/509
6,070,532 A * 6/2000 Halverson ..... F42B 14/02 102/501
6,317,946 B1 * 11/2001 Beal ..... F42B 12/74 102/516
6,371,029 B1 * 4/2002 Beal ..... F42B 12/74 102/506
6,457,417 B1 * 10/2002 Beal ..... F42B 12/74 102/517
6,502,625 B2 * 1/2003 Pullum ..... B22D 15/04 164/264
6,591,730 B2 * 7/2003 Beal ..... F41B 11/72 102/506
6,840,149 B2 * 1/2005 Beal ..... B22F 1/0003 102/516
6,959,648 B2 * 11/2005 Piela ..... F42B 5/025 102/511
7,059,233 B2 * 6/2006 Amick ..... A01K 95/005 102/517
7,069,834 B2 7/2006 Beal
7,217,389 B2 * 5/2007 Amick ..... B22F 1/0003 102/517
7,243,588 B2 * 7/2007 Beal ..... F42B 12/74 102/517
7,302,891 B1 * 12/2007 Adams ..... F42B 5/025 102/439
7,406,906 B2 * 8/2008 Beal ..... F42B 30/02 86/54
7,597,037 B2 * 10/2009 Beal ..... F42B 12/34 86/53
8,186,277 B1 * 5/2012 King ..... F42B 12/74 102/507
10,222,183 B2 * 3/2019 Smith ..... B22F 1/0062
2002/0117074 A1 * 8/2002 Beal ..... F42B 12/74 102/516
2002/0134197 A1 * 9/2002 Beal ..... F42B 12/74 75/252
2006/0042456 A1 * 3/2006 Petersen ..... F42B 12/74 86/54
2012/0111220 A1 * 5/2012 King ..... F42B 12/34 102/509
2014/0318406 A1 * 10/2014 Rall ..... F42B 33/001 102/510
2015/0033973 A1 * 2/2015 Harvey ..... B21J 9/06 102/501
2015/0107481 A1 * 4/2015 Nygaard ..... F42B 12/74 102/514
2016/0258724 A1 * 9/2016 Smith ..... B22F 1/0062
2017/0108320 A1 * 4/2017 Peterson ..... F42B 12/74
2017/0268858 A1 * 9/2017 Morse ..... F42B 12/367
2017/0276463 A1 * 9/2017 Tubb ..... F42B 5/03
2017/0336186 A1 * 11/2017 Smith ..... F42B 12/34
2018/0038673 A1 * 2/2018 Fridlund ..... F42B 33/00
2018/0106581 A1 * 4/2018 Rogers ..... F42B 33/00
2018/0120069 A1 * 5/2018 Kim ..... F42B 10/44
2018/0224249 A1 * 8/2018 Carbone ..... F42B 10/46
2019/0186881 A1 * 6/2019 Spanner ..... F42B 8/12
2019/0316888 A1 * 10/2019 Thielen ..... F42B 12/34
2020/0094319 A1 * 3/2020 Nichols ..... F42B 33/00

* cited by examiner

DIE ASSEMBLIES FOR FORMING A FIREARM PROJECTILE, METHODS OF UTILIZING THE DIE ASSEMBLIES, AND FIREARM PROJECTILES

RELATED APPLICATION

This application claims priority to U.S. Provisional Patent Application No. 62/736,695, which was filed on Sep. 26, 2018, and the complete disclosure of which is hereby incorporated by reference.

FIELD OF THE DISCLOSURE

The present disclosure relates to die assemblies for forming a firearm projectile, to methods of utilizing the die assemblies, and/or to firearm projectiles formed utilizing the methods and/or the die assemblies.

BACKGROUND OF THE DISCLOSURE

Conventional powder metallurgy may be utilized to form firearm projectiles, including bullets. However, the shapes of firearm projectiles that may be formed utilizing conventional powder metallurgy techniques may be limited for several reasons. As an example, it may not be possible to form double-tapered firearm projectiles (e.g., firearm projectiles that taper on both a leading end and a tailing end thereof) utilizing conventional powder metallurgy techniques. As another example, it may not be possible to form firearm projectiles that include both a hollow point and a boat tail utilizing conventional powder metallurgy techniques. As yet another example, it may be difficult to compress a metallic powder, which is utilized to form the firearm projectiles, to a desired and/or needed level of compression utilizing conventional powder metallurgy techniques. Thus, there exists a need for improved die assemblies for forming a firearm projectile, for improved methods of utilizing the die assemblies, and/or for improved firearm projectiles formed utilizing the methods and/or the die assemblies.

SUMMARY OF THE DISCLOSURE

Die assemblies for forming a firearm projectile and methods of utilizing the die assemblies are disclosed herein. The die assemblies include a forming die, a first punch, and a second punch. The forming die may define a first side, a second side that is opposed to the first side, and a die cavity that extends between the first side and the second side. The first punch may be configured to seal against the forming die from the first side. The second punch may be configured to be received within the die cavity from the second side. When the first punch seals against the forming die and the second punch is received within the die cavity, the first punch, the second punch, and the forming die collectively may define a forming surface shaped to define an external contour of the firearm projectile. The forming die may define a die region of the forming surface, the first punch may define a first region of the forming surface, and the second punch may define a second region of the forming surface. In some examples, the forming surface may be shaped to define a hollow-point, boat-tail firearm projectile.

The methods include positioning the second punch within a region of the die cavity, such as from the second side of the forming die, and metering a volume of metallic powder into a remainder of the die cavity. The methods also include sealing the first punch against the forming die, such as from the first side of the forming die, and extending the second punch into the die cavity to compress the metallic powder and/or to form the projectile within the forming surface of the die assembly.

DETAILED DESCRIPTION AND BEST MODE OF THE DISCLOSURE

Figure 1:
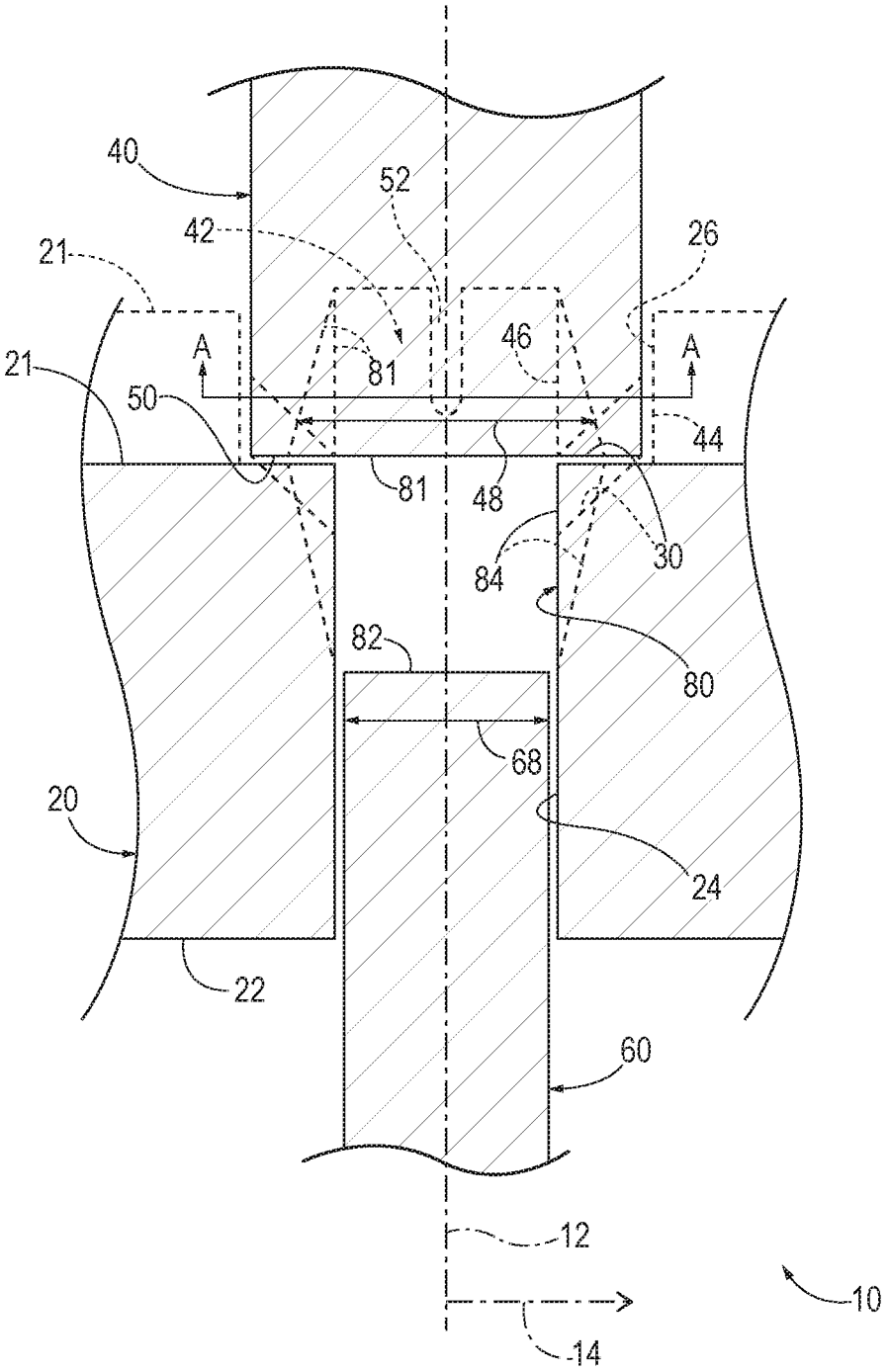
FIG. 1 is a schematic illustration of examples of die assemblies according to the present disclosure.

FIGS. 1-9 provide examples of die assemblies 10, of methods 100 of utilizing die assemblies 10, and/or of firearm projectiles 90 that may be formed utilizing methods 100 and/or die assemblies 10, according to the present disclosure. Elements that serve a similar, or at least substantially similar, purpose are labeled with like numbers in each of FIGS. 1-9, and these elements may not be discussed in detail herein with reference to each of FIGS. 1-9. Similarly, all elements may not be labeled in each of FIGS. 1-9, but reference numerals associated therewith may be utilized herein for consistency. Elements, components, and/or features that are discussed herein with reference to one or more of FIGS. 1-9 may be included in and/or utilized with any of FIGS. 1-9 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

Figure 2:
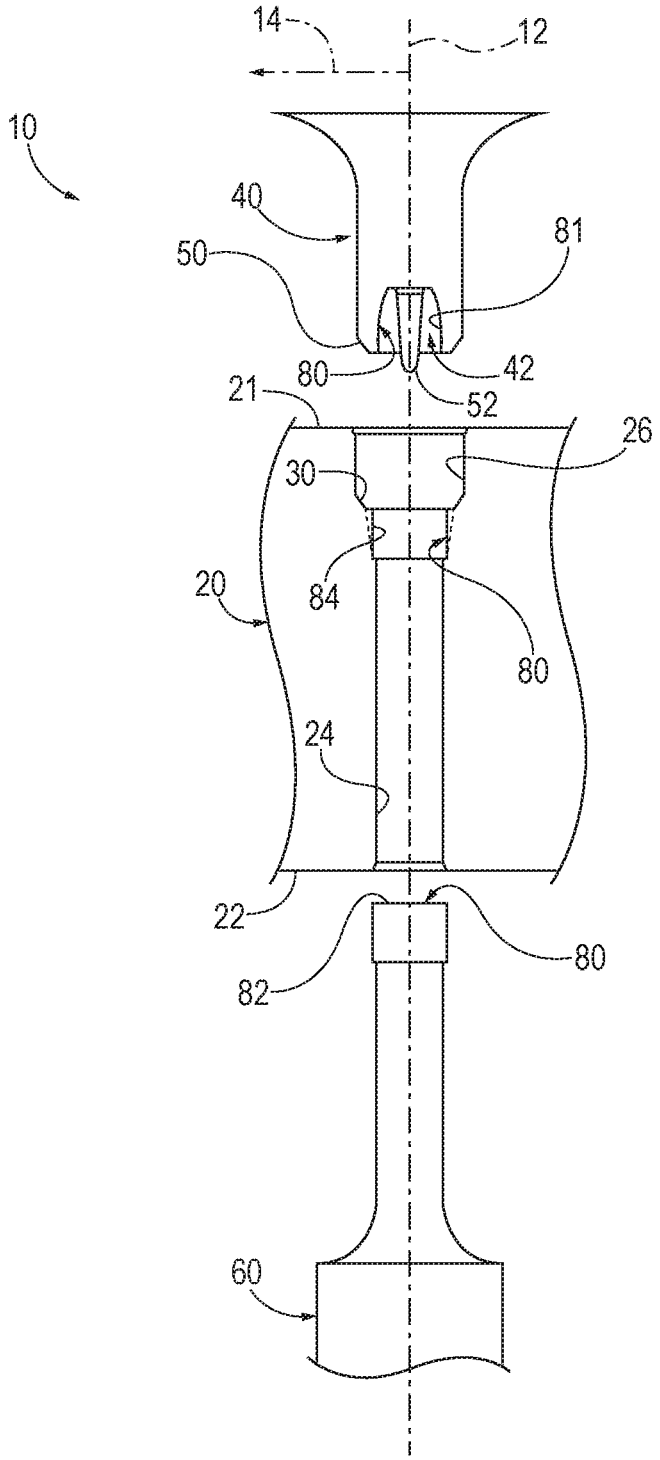
FIG. 2 is a less schematic illustration of an example of a die assembly according to the present disclosure.

FIG. 1 is a schematic illustration of examples of die assemblies 10 according to the present disclosure, and FIG. 2 is a less schematic illustration of an example of a die assembly 10 according to the present disclosure. As discussed in more detail herein with reference to methods 100 of FIG. 3, die assemblies 10 may be utilized to form a firearm projectile, such as firearm projectiles 90 of FIGS. 7-9, via compression of a metallic powder.

As illustrated in FIGS. 1-2, die assemblies 10 include a forming die 20, a first punch 40, and a second punch 60. Forming die 20 defines a first side 21 and a second side 22. Forming die 20 also defines a die cavity 24 that extends between first side 21 and second side 22 of the forming die. First punch 40 is configured to seal against forming die 20 from first side 21, and second punch 60 is configured to be received within die cavity 24 from second side 22.

Figure 3:
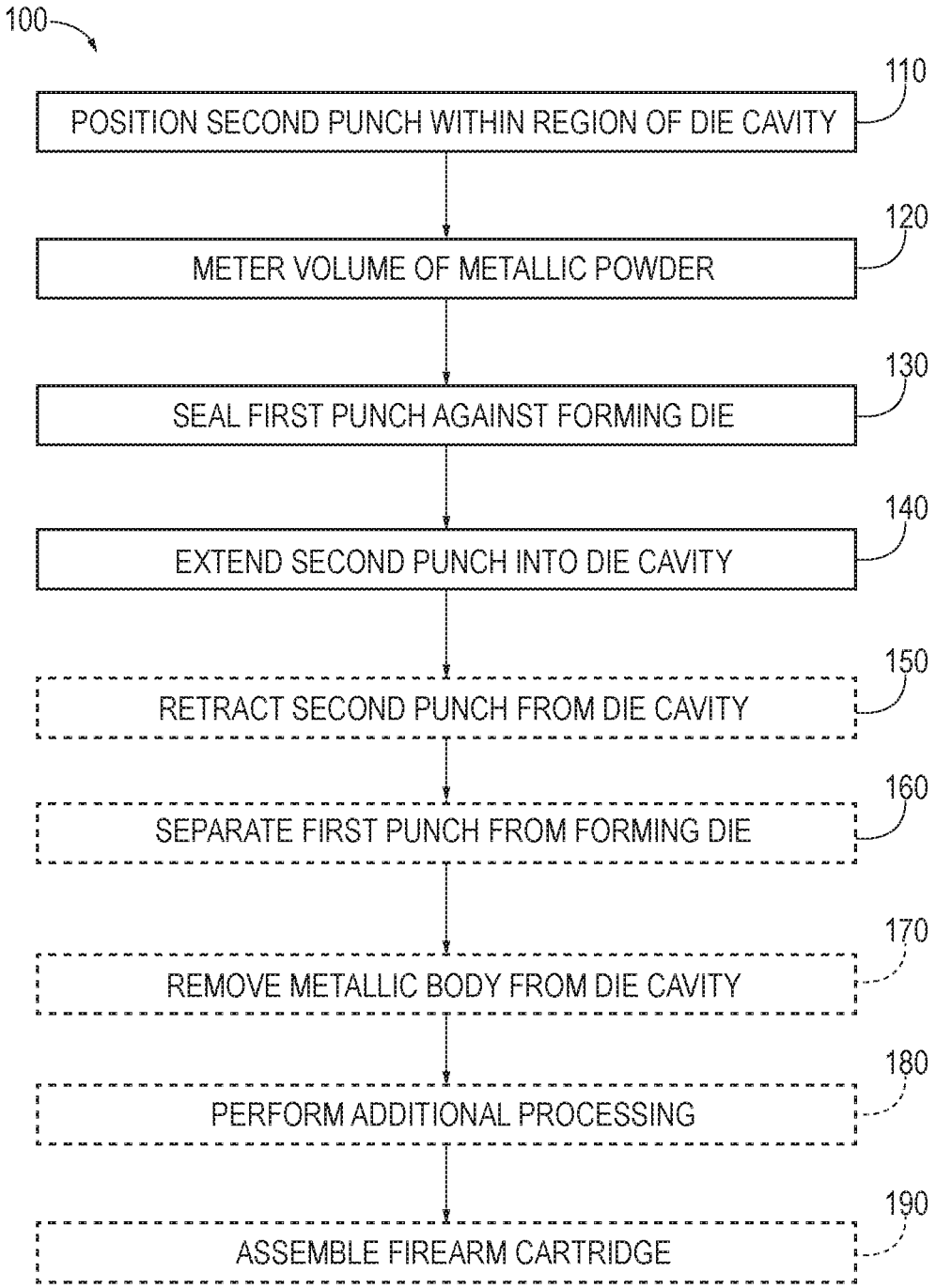
FIG. 3 is a flowchart depicting examples of methods of forming a firearm projectile utilizing a die assembly, according to the present disclosure.

During operation and/or utilization of forming die 10, such as during methods 100 of FIG. 3, first punch 40 may seal against forming die 20, and second punch 60 may be received within die cavity 24 such that the first punch, the second punch, and the forming die define, or collectively define, a forming surface 80. Forming surface 80 is shaped to define an external contour, to define an external shape, and/or to shape an external surface of the firearm projectile.

More specifically, forming die 20 may define a die region 84 of forming surface 80, first punch 40 may define a first region 81 of forming surface 80, and second punch 60 may define a second region 82 of forming surface 80. First region 81, or a shape of first region 81, may correspond to the nose, to a nose portion, to a shape of the nose, and/or to a shape of the nose portion of the firearm projectile, and second region 82, or a shape of second region 82, may correspond to the shank, to a tail region, to a shape of the shank, and/or to a shape of the tail region of the firearm projectile. Similarly, die region 84, or a shape of die region 84, may correspond to a central portion, to a major diameter, to a shape of the central portion, and/or to a size of the major diameter of the firearm projectile.

Forming die 20 may include any suitable structure that may define first side 21, second side 22, and/or die cavity 24 and/or that may define die region 84 of forming surface 80. In addition, forming die 20 may include and/or be formed from any suitable material and/or materials. As examples, forming die 20 may include and/or be one or more of a rigid forming die, an at least substantially rigid forming die, and/or a metallic forming die. In some examples, forming die 20 may include and/or be a unitary, a monolithic, a single-piece, and/or a machined forming die 20.

Figure 8:
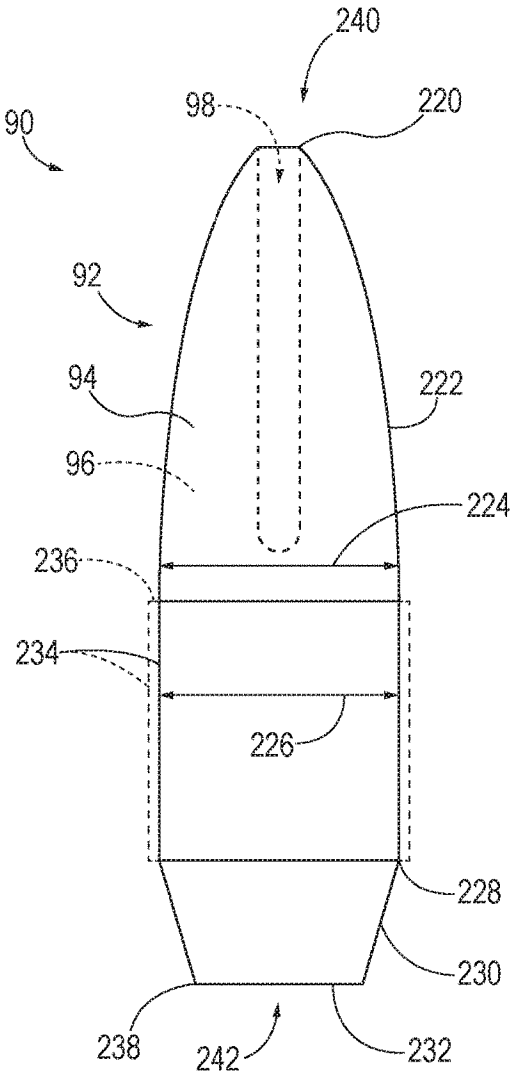
FIG. 8 is an illustration of examples of firearm projectiles that may be formed utilizing die assemblies and/or methods according to the present disclosure.

Die cavity 24 may include and/or define any suitable shape that may extend between first side 21 and second side 22 of forming die 20, that at least partially receives first punch 40, that may seal against first punch 40, and/or that may at least partially receive second punch 60. As an example, die cavity 24 may include and/or be a cylindrical, an at least substantially cylindrical, and/or an at least partially cylindrical die cavity. As another example, die cavity 24 may be shaped to slidingly receive second punch 60 along a longitudinal axis 12 of the die cavity and/or of the second punch. As yet another example, a, or even every, transverse cross-section of die cavity 24 may be circular, or at least substantially circular. Such transverse cross-sections may be taken within a plane that is perpendicular to longitudinal axis 12 and/or that is parallel, or coextensive, with a transverse, or radial, axis 14 of the die cavity and/or of the second punch. As another example, die cavity 24 may be rotationally symmetric about longitudinal axis 12. As yet another example, die cavity 24 may be shaped to define a shoulder, a bearing surface, a shank, a leading end, and/or a caliber diameter of the firearm projectile, as illustrated in FIG. 8.

All transverse cross-sections and/or all transverse cross-sectional areas referenced, disclosed, and/or referred to herein are defined within the plane that is perpendicular to longitudinal axis 12 and/or that is parallel and/or coextensive with transverse axis 14 of die cavity 24. As illustrated, longitudinal axis 12 of die cavity 24 extends along a length of die cavity 24 and/or between first side 21 and second side 22 of the forming die. As illustrated, longitudinal axis 12 extends through and/or along an entirety of the die cavity and generally will extend perpendicular to first side 21 and/or second side 22; however, this is not required of all embodiments. When, as illustrated in FIG. 1, first punch 40 forms the seal with forming die 20 and second punch 60 is received within die cavity 24, longitudinal axis 12 may be referred to herein as being, or as being coextensive with, a longitudinal axis of the first punch and/or as being a longitudinal axis of the second punch. It should be understood that the first punch and the second punch define corresponding longitudinal axes that are independent from longitudinal axis 12 of forming die 20, with these corresponding longitudinal axes being coextensive with longitudinal axis 12 in the configuration illustrated in FIGS. 1-2.

As illustrated in dashed lines in FIG. 1 and in solid lines in FIG. 2, forming die 20 and/or die cavity 24 thereof may include and/or define a first receiving region 26. First receiving region 26, when present, may be shaped and/or configured to receive, or to receive at least a portion of, first punch 40. When forming die 20 includes first receiving region 26, a transverse cross-sectional area, or an average transverse cross-sectional area, of the first receiving region 26 may be greater than a maximum transverse cross-sectional area of, defined within, and/or bounded by forming surface 80. As examples, the, or the average, transverse cross-sectional area of first receiving region 26 may be at least 1.1, at least 1.2, at least 1.3, at least 1.4, at least 1.6, at least 1.8, and/or at least 2 times greater than the maximum transverse cross-sectional area of forming surface 80.

First receiving region 26, when present, may have and/or define any suitable shape. As examples, the first receiving region may be cylindrical, at least substantially cylindrical, and/or at least partially cylindrical. As another example, the first receiving region may be rotationally symmetric about longitudinal axis 12.

When forming die 20 includes first receiving region 26, first punch 40 may be, or may be referred to herein as being, at least partially within, or received within, first receiving region 26 and/or at least partially within, or received within, die cavity 24 when the first punch seals against the forming die. Alternatively, when forming die 20 does not include first receiving region 26, first punch 40 may be, or may be referred to herein as being, external to die cavity 24 when the first punch seals against the forming die.

First punch 40 may include any suitable structure that may be configured to seal against forming die 20 from first side 21 of the forming die and/or that may define first region 81 of forming surface 80. In addition, first punch 40 may include and/or be formed from any suitable material and/or materials. As examples, first punch 40 may include and/or be one or more of a rigid first punch, an at least substantially rigid first punch, and/or a metallic first punch. In some examples, first punch 40 may include and/or be a unitary, a monolithic, a single-piece, and/or a machined first punch 40.

First punch 40 may include and/or define any suitable shape that may be at least partially received within die cavity 24, that seal against forming die 20, and/or that may define first region 81 of forming surface 80. As an example, first punch 40 may include and/or be a cylindrical, an at least substantially cylindrical, and/or an at least partially cylindrical first punch. As another example, first punch 40 may be shaped to seal against forming die 20. As yet another example, a, or even every, transverse cross-section of a region of first punch 40 that defines die cavity 24 may be circular, or at least substantially circular. As another example, first punch 40 may be rotationally symmetric about longitudinal axis 12. As yet another example, first punch 40 may be configured to form and/or define a point, a leading end, an ogive, a nose, a nose region, a shoulder, and/or a major diameter of the firearm projectile.

As illustrated in dashed lines in FIG. 1 and in solid lines in FIG. 2, first punch 40 may include and/or define a forming cavity 42 that may at least partially define first region 81 of forming surface 80. Forming cavity 42, when present, may extend within first punch 40 and/or may taper into the first punch. Stated another way, a transverse cross-sectional area of forming cavity 42 may decrease, or even monotonically decrease, as the forming cavity extends into the first punch.

It is within the scope of the present disclosure that first punch 40 may be larger than, may have a greater cross-sectional area than, and/or may extend radially outward relative to forming surface 80. Stated another way, first punch 40 may define a first punch transverse cross-sectional area 44 that is bounded by an outer perimeter of a transverse cross-section (e.g., cross-section A-A of FIG. 1) of a portion of the first punch that defines, or at least partially defines, first region 81 of forming surface 80. Similarly, an outer perimeter of first region 81 of forming surface 80 that extends within the, or within the same, transverse cross-section may define a forming cavity transverse cross-sectional area 46. The first punch transverse cross-sectional area may be greater than the forming cavity transverse cross-sectional area. As examples, the first punch transverse cross-sectional area may be at least 1.1, at least 1.2, at least 1.3, at least 1.4, at least 1.6, at least 1.8, and/or at least 2 times greater than the forming cavity transverse cross-sectional area. Such a relationship between the first punch transverse cross-sectional area and the forming cavity transverse cross-sectional area may be observed for each, or every, transverse cross-section of first punch 40 that intersects forming surface 80.

It also is within the scope of the present disclosure that a first maximum dimension 48 of a transverse cross-section of first region 81 of forming surface 80 that is defined by first punch 40 may be larger than, may have a greater cross-sectional area than, and/or may extend radially outward relative to a second maximum dimension 68 of a transverse cross-section of the second region of the forming surface that is defined by the second punch.

As discussed, first punch 40 is configured to seal against forming die 20 from first side 21 of the forming die. This seal may be formed, defined, and/or facilitated in any suitable manner. As an example, first punch 40 may include and/or define a first punch sealing surface 50 configured to seal against forming die 20. First punch sealing surface 50 may extend from, or may extend radially outward from, forming surface 80 and/or from first region 81 of the forming surface. Stated another way, a maximum transverse cross-sectional dimension of first punch sealing surface 50 may be greater than a, or than any, maximum transverse cross-sectional dimension of forming surface 80 and/or of first region 81 of the forming surface.

Similarly, forming die 20 may include and/or define a, or a complementary, die sealing surface 30 configured to seal against first punch 40 and/or against first punch sealing surface 50 of the first punch. Die sealing surface 30 may extend from, or may extend radially outward from, forming surface 80 and/or die region 84 of the forming surface. Stated another way, a maximum transverse cross-sectional dimension of die sealing surface 30 may be greater than a, or than any, maximum transverse cross-sectional dimension of forming surface 80 and/or of die region 84 of the forming surface.

As illustrated in FIG. 2, die sealing surface 30 and/or first punch sealing surface 50 may extend at a skew angle relative to longitudinal axis 12. As examples, the die sealing surface and/or the first punch sealing surface may extend at an acute angle, at an obtuse angle, and/or at least substantially at 45 degrees relative to the longitudinal axis. As additional examples, die sealing surface 30 and/or first punch sealing surface 50 may extend at least at a 20 degree angle, at least at a 25 degree angle, at least at a 30 degree angle, at least at a 35 degree angle, at least at a 40 degree angle, at a 45 degree angle, at least at a 45 degree angle, at least at a 50 degree angle, at least at a 55 degree angle, at least at a 60 degree angle, at most at a 70 degree angle, at most at a 65 degree angle, at most at a 60 degree angle, at most at a 55 degree angle, at most at a 50 degree angle, at most at a 45 degree angle, at most at a 40 degree angle, at most at a 35 degree angle, and/or at most at a 30 degree angle relative to the longitudinal axis. However, this is not required of all embodiments, and it is within the scope of the present disclosure that, as illustrated in FIG. 1, die sealing surface 30 and/or first punch sealing surface 50 may extend perpendicular to (e.g., at a 90 degree angle relative to) longitudinal axis 12. Die sealing surface 30 and first punch sealing surface 50 may extend at the same, or at least substantially the same, angles relative to longitudinal axis 12. As such, die sealing surface 30 and first punch sealing surface 50 may be configured for face-to-face contact when first punch 40 seals against forming die 20.

Second punch 60 may include any suitable structure that may be configured to be received within die cavity 24 from second side 22 of forming die 20 and/or that may define second region 82 of forming surface 80. In addition, second punch 60 may include and/or be formed from any suitable material and/or materials. As examples, second punch 60 may include and/or be one or more of a rigid second punch, an at least substantially rigid second punch, and/or a metallic second punch. In some examples, second punch 60 may include and/or be a unitary, a monolithic, a single-piece, and/or a machined second punch 60.

Second punch 60 may include and/or define any suitable shape that may be at least partially received within die cavity 24 and/or that may define second region 82 of forming surface 80. As an example, second punch 60 may include and/or be a cylindrical, an at least substantially cylindrical, and/or an at least partially cylindrical second punch. As another example, a, or even every, transverse cross-section of second punch 60 may be circular, or at least substantially circular. As yet another example, second punch 60 may be rotationally symmetric about longitudinal axis 12. As another example, second punch 60 may be configured to form and/or define a base, a heel, a tail, a boat-tail, and/or a trailing end of the firearm projectile, as illustrated in FIG. 8.

Forming surface 80 may have and/or define any suitable shape and/or shapes that may be at least partially, completely, and/or collectively defined by die region 84, by first region 81, and by second region 82. As an example, forming surface 80 may include and/or be a cylindrical, an at least substantially cylindrical, and/or an at least partially cylindrical forming surface 80. As another example, a, or even every, transverse cross-section of forming surface 80 may be circular, or at least substantially circular. As yet another example, forming surface 80 may be rotationally symmetric about longitudinal axis 12.

As discussed, forming surface 80 may be shaped to define the external contour of a firearm projectile, such as but not limited to a bullet. The firearm projectile may include one or more of a boat-tail firearm projectile and/or a hollow-point firearm projectile.

Die region 84 of forming surface 80 may define a central portion of the forming surface. The central portion of the forming surface may define a maximum transverse cross-sectional dimension of the forming surface, which may define a caliber diameter of the firearm projectile. Examples of the maximum transverse cross-sectional dimension of the forming surface include at least 4 millimeters (mm), at least 4.5 mm, at least 5 mm, at least 5.5 mm, at least 5.56 mm, at least 6 mm, at least 7 mm, at least 8 mm, at least 9 mm, at least 10 mm, at least 12 mm, at least 14 mm, at least 16 mm, at most 22 mm, at most 20 mm, at most 18 mm, at most 16 mm, at most 14 mm, at most 12 mm, at most 11 mm, at most 10 mm, at most 9 mm, at most 8 mm, at most 7 mm, and/or at most 6 mm.

In some examples, and as illustrated in dashed lines in FIGS. 1-2, forming surface 80 and/or die region 84 thereof may taper away from the central portion of the forming surface, such as toward first punch 40 and/or toward second punch 60. Stated another way, die region 84 may be tapered, or may be at least partially tapered. Stated yet another way, die region 84 may at least partially define an external contour of a boat-tail of the boat-tail projectile.

As illustrated in FIGS. 1-2, first region 81 of forming surface 80 may define, or may at least partially define, an external contour of a point, or of a hollow-point, of the hollow-point projectile. When die assembly 10 is configured to form and/or define the hollow-point projectile, first punch 40 and/or first region 81 may include a central projection 52. Central projection 52 may be shaped to define a hollow, or a recessed, region of the hollow-point projectile, may extend along longitudinal axis 12, and/or may project toward forming die 20 when first punch 40 seals against the forming die.

Central projection 52 may have and/or define any suitable shape. As an example, central projection 52 may be rotationally symmetric about longitudinal axis 12. As another example, a, or even every, transverse cross-section of central projection 52 may be circular, or at least substantially circular. As yet another example, central projection may taper, or decrease in diameter, as it projects from a remainder of the first punch.

As illustrated in FIGS. 1-2, second region 82 of forming surface 80 may be planar, or at least substantially planar. Additionally or alternatively, second region 82 of forming surface 80 may be arcuate, may be curved, may be cupped, may be concave, may be convex, and/or may be symmetrical about longitudinal axis 12.

Figure 7:
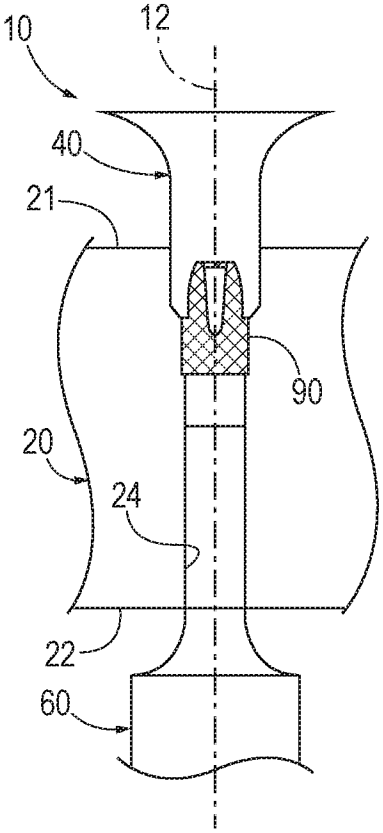
FIG. 7 is an illustration of a portion of the method of FIG. 3.
Figure 9:
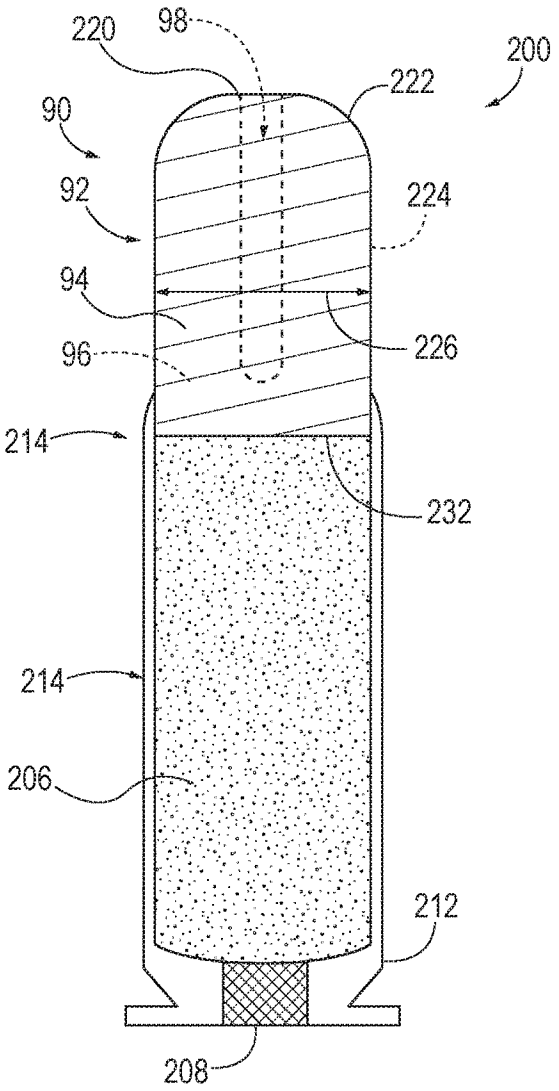
FIG. 9 is an illustration of an example of a firearm cartridge that may include a firearm projectile produced according to the present disclosure.

FIG. 3 is a flowchart depicting examples of methods 100 of forming a firearm projectile, such as firearm projectile 90 of FIGS. 7-9, utilizing a die assembly, according to the present disclosure. FIGS. 4-7 are illustrations of portions of the method of FIG. 3. Additional examples of die assemblies that may be utilized with methods 100 are illustrated in FIGS. 1-2 and indicated at 10.

Methods 100 include positioning a second punch within a region of a die cavity at 110 and metering a volume of metallic powder at 120. Methods 100 also include sealing a first punch against a forming die at 130 and extending the second punch into the die cavity at 140. Methods 100 also may include retracting the second punch from the die cavity at 150, separating the first punch from the forming die at 160, and/or removing the firearm projectile from the die cavity at 170. Methods 100 further may include performing additional processing at 180 and/or assembling a firearm cartridge at 190.

Positioning the second punch within the region of the die cavity at 110 may include positioning the second punch from a second side of the forming die, such as from second side 22 and/or from opposite first side 21 of FIGS. 1-2 and 4-7. This may include slidingly translating the second punch within the die cavity and/or slidingly translating the second punch along a longitudinal axis of the die cavity, such as toward first punch 40 and/or toward first side 21 of FIGS. 1-2. The positioning at 110 may be performed without applying and/or generating a normal load, or a normal force, that is directed between the forming die and the second punch. Stated another way, the positioning at 110 may include positioning without applying a force between the forming die and the second punch, at least in a direction that is parallel to the longitudinal axis of the die cavity.

Figure 4:
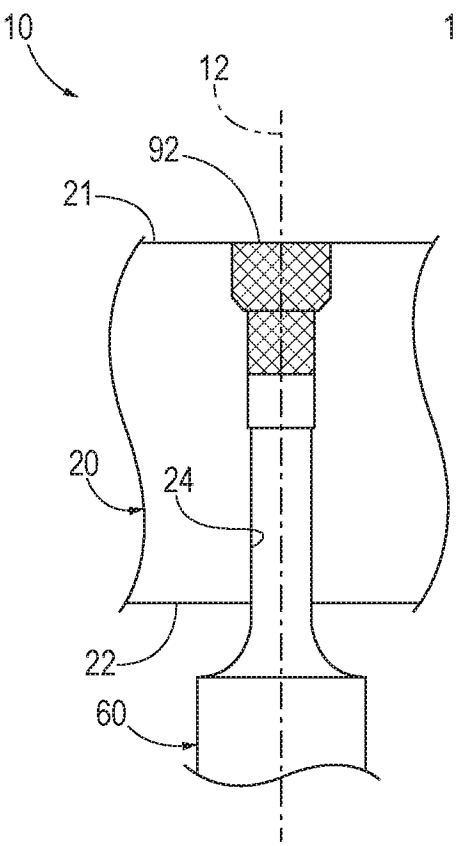
FIG. 4 is an illustration of a portion of the method of FIG. 3.

An example of the positioning at 110 is illustrated in FIG. 4. Therein, second punch 60 is positioned within die cavity 24. As discussed, the positioning at 110 was accomplished by inserting the second punch into the die cavity from second side 22 of the forming die and slidingly translating the second punch along longitudinal axis 12 of the die cavity, such as toward first side 21.

Metering the volume of metallic powder at 120 may include metering the metallic powder into a remainder of the die cavity. Stated another way, and during the positioning at 110, the second punch may extend within and/or may fill the region of the die cavity, and this region of the die cavity may be less than an entirety of the die cavity. Under these conditions, the remainder of the die cavity, which was not filled by the second punch during the positioning at 110, may be filled with the metallic powder during the metering at 120.

The metering at 120 may include metering a predetermined, or a preselected, mass and/or volume of the metallic powder into the remainder of the die cavity. As may be appreciated, a magnitude of the volume of metallic powder may be selectively adjusted and/or varied by varying a fraction of the die cavity that is filled by the second punch during the positioning at 110.

The metering at 120 further may include partially retracting the second punch from the die cavity such that the die cavity defines an empty cavity region, a powder-filled cavity region, and a second punch-filled cavity region. Under these conditions, the sealing at 130 may include positioning the first punch within the empty cavity region, as discussed in more detail herein.

Figure 5:
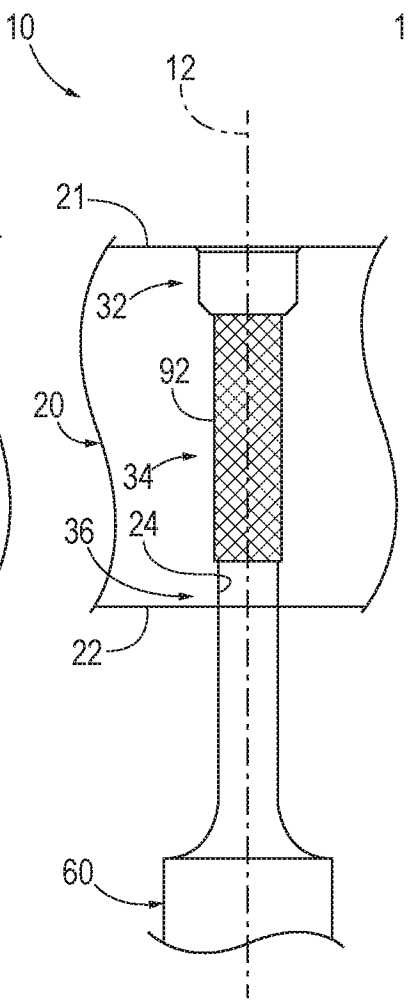
FIG. 5 is an illustration of a portion of the method of FIG. 3.

An example of the metering at 120 is illustrated in FIGS. 4-5. As illustrated in FIG. 4, the remainder of die cavity 24 that is not filled by second punch 60 is filled with a metallic powder 92. As illustrated in FIG. 5, second punch 60 then may be partially retracted from die cavity 24 such that the die cavity defines an empty cavity region 32, a powder-filled cavity region 34, and a second punch-filled cavity region 36.

The metering at 120 may include metering any suitable metallic powder into the remainder of the die cavity. Examples of the metallic powder include zinc powder, iron powder, bismuth powder, tin powder, copper powder, nickel powder, tungsten powder, boron powder, powders of alloys of one or more of these metals, and/or mixtures of one or more of these powders. In addition to one or more metals, the metallic powder also may include one or more non-metallic components. Examples of these non-metallic components include polymers, binders, lubricants, waxes, polymeric binders, anti-sparking agents, borate, boric acid, zinc chloride, and/or petrolatum. When the metallic powder includes non-metallic components, the metal powder may include at least a threshold weight percentage of metal. Examples of the threshold weight percentage include at least 50%, at least 60%, at least 70%, at least 80%, at least 90%, at least 95%, at least 98%, at most 99.5%, at most 99%, at most 97%, at most 95%, at most 90%, at most 85%, at most 80%, at most 75%, at most 70%, at most 65%, and/or at most 60%. The metallic powder generally will be at least 50%, by weight, metal.

Sealing the first punch against the forming die at 130 may include sealing the first punch against the forming die from the first side of the forming die. The sealing at 130 may be accomplished in any suitable manner. As an example, the sealing at 130 may include engaging, contacting, and/or directly and physically contacting a die sealing surface of the forming die with a first punch sealing surface of the first punch. As another example, the sealing at 130 may include applying, or directly applying, a sealing load, which may be directed along the longitudinal axis of the first punch and/or of the die cavity, between the first punch and the forming die.

Figure 6:
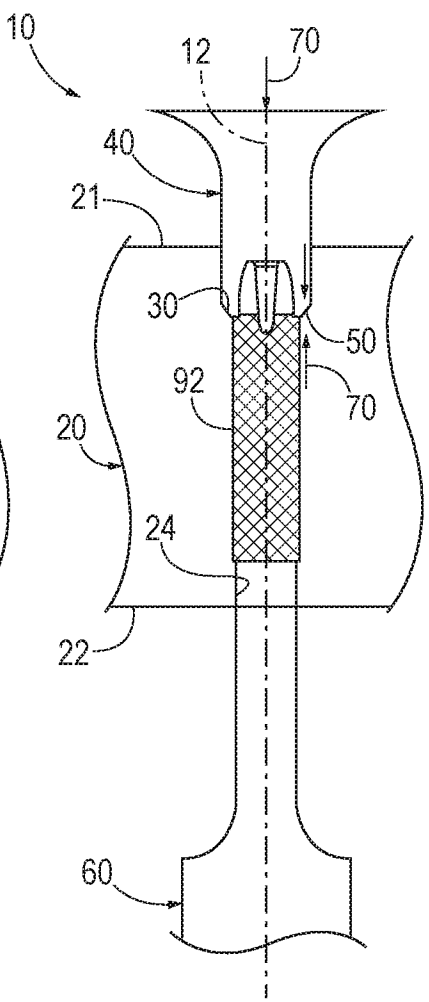
FIG. 6 is an illustration of a portion of the method of FIG. 3.

An example of the sealing at 130 is illustrated in FIG. 6. In FIG. 6, first punch 40 forms a seal against forming die 20. This seal may be defined between a die sealing surface 30 of the forming die and a first punch sealing surface 50 of the first punch. Additionally or alternatively, the seal may be defined by applying a sealing load, or force, 70 along longitudinal axis 12 and/or between the first punch and the forming die.

Extending the second punch into the die cavity at 140 may include extending the second punch to compress and/or to compact the metallic powder and/or to form the firearm projectile within the die assembly and/or with a forming surface of the forming die. As discussed in more detail herein with reference to FIGS. 1-2, the forming surface may be collectively defined by the first punch, the second punch, and the forming die.

The extending at 140 may include applying at least a threshold pressure to the metallic powder. Examples of the threshold pressure include pressures of at least 100 megapascals, at least 200 megapascals, at least 300 megapascals, at least 400 megapascals, at least 500 megapascals, at least 600 megapascals, at least 700 megapascals, at least 800 megapascals, and/or at least 900 megapascals. The dimensions of the first punch and/or the fact that the maximum transverse dimension of the first punch is greater than the maximum transverse dimension of the forming surface may permit and/or facilitate forming at relatively higher pressures when compared to a conventional firearm projectile forming assembly that does not include the first punch and/or the forming die of die assemblies according to the present disclosure.

Additionally or alternatively, the extending at 140 may include extending until the metallic powder is compressed to a threshold density and/or to within a threshold density range. Stated another way, the extending at 140 may include extending such that a density of the firearm projectile formed during methods 100 has the threshold density and/or is within the threshold density range. Examples of the threshold density and/or of bounds on the threshold density range include at least 6 grams per cubic centimeter (g/cc), at least 6.5 g/cc, at least 7 g/cc, at least 7.5 g/cc, at least 8 g/cc, at least 8.5 g/cc, at least 9 g/cc, at least 9.5 g/cc, at least 10 g/cc, at least 11 g/cc, at least 12 g/cc, at least 13 g/cc, at most 16 g/cc, at most 14 g/cc, at most 12 g/cc, at most 10 g/cc, at most 9.5 g/cc, at most 9 g/cc, at most 8.5 g/cc, at most 8 g/cc, at most 7.5 g/cc, and/or at most 7 g/cc.

The extending at 140 may include slidingly extending the second punch into the die cavity and/or slidingly receiving the second punch within the die cavity. This may include extending the second punch along the longitudinal axis of the second punch, toward the first punch, and/or along the longitudinal axis of the die cavity.

Additionally or alternatively, the extending at 140 may include extending without directly applying an extending load, which is directed along the longitudinal axis of the second punch, between the second punch and the forming die. Stated another way, the metallic powder spatially separates the second punch and the forming die such that any load applied along the longitudinal axis and during the extending at 140 is applied to the forming die by the second punch via the metallic powder.

The extending at 140 may include forming the firearm projectile with a single extension of the second punch. Stated another way, the extending at 140 may include extending the second punch a single time, or only the single time. Stated yet another way, after, or immediately after, the single extension of the second punch, the firearm projectile may have and/or define at least the threshold density and/or may be within the threshold density range.

An example of the extending at 140 is illustrated by the transition from FIG. 6 to FIG. 7. As illustrated, second punch 60 is extended into die cavity 24, thereby compressing metallic powder 92 to form and/or define firearm projectile 90.

Retracting the second punch from the die cavity at 150 may include removing the second punch from the die cavity. This may include slidingly moving the second punch along the longitudinal axis of the second punch and/or of the die cavity and in a direction that is opposed to the direction in which the second punch was extended during the extending at 140. Stated another way, the retracting at 150 may include moving the second punch in a retraction direction that is away from the second surface of the forming die, away from the first punch, and/or away from the first side of the forming die. Additionally or alternatively, the retracting at 150 may include separating and/or removing the second punch from the die cavity.

Separating the first punch from the forming die at 160 may include ceasing the seal between the first punch and the forming die. This may include moving the first punch away from the forming die, moving the first punch away from the first surface of the forming die, and/or establishing a spaced-apart relationship between the first punch and the forming die.

Removing the firearm projectile from the die cavity at 170 may include establishing a spaced-apart relationship between the firearm projectile and the forming die, the first punch, and/or the second punch. This may include ejecting the firearm projectile from the die cavity, or providing a motive force for the removing at 170, with the second punch, such as by extending the second punch further into the die cavity subsequent to the separating at 160 and/or prior to the retracting at 150. The removing at 170 may include removing the firearm projectile from the die cavity from the first side of the forming die.

Performing additional processing at 180 may include performing one or more additional processing steps on the firearm projectile. Examples of the additional processing steps include heat treating the firearm projectile, jacketing the firearm projectile, working the firearm projectile, reshaping the firearm projectile, plating the firearm projectile, and/or coating the firearm projectile with a coating material. Another example of the additional processing steps includes repeating at least a subset of methods 100, such as the extending at 140, to re-compress, to re-compact, to further compress, and/or to further compact the firearm projectile.

Assembling the firearm cartridge at 190 may include assembling, or utilizing, the firearm projectile into and/or within the firearm cartridge, an example of which is illustrated in FIG. 9 and indicated at 200. The assembling may include seating the firearm projectile within a mouth of a casing of the firearm projectile, positioning a primer within a head portion of the casing, and/or positioning a propellant within the casing.

FIG. 8 illustrates examples of firearm projectiles 90 that may be formed utilizing die assemblies 10 and/or methods 100 according to the present disclosure. FIG. 9 illustrates an example of a firearm cartridge 200 that may include a firearm projectile 90, such as a bullet, according to the present disclosure. As illustrated in FIGS. 8-9, firearm projectiles 90 may include a compacted mixture 94 of metallic powder 92 that optionally may include one or more non-metallic components 96.

A shape of firearm projectiles 90 may vary depending upon a specific application for the firearm projectiles. In the example of FIGS. 8-9, the firearm projectile may include a hollow-point 98 that extends from a point, or meplat, 220. Point 220 also may be referred to herein as a tip and/or as a leading end 240 of the firearm projectile. A nose, or ogive, 222 of the firearm projectile may taper away from point 220 to a major diameter 224 and/or to a caliber diameter 226 of the firearm projectile. Major diameter 224 and/or caliber diameter 226 may define a bearing surface 234 of the firearm projectile.

As illustrated in FIG. 8, firearm projectiles 90 may include a shoulder 236. Shoulder 236, when present, may form and/or define a transition between two adjacent regions of the firearm projectile, such as between bearing surface 234 and nose 222 in the example of FIG. 8.

As illustrated in FIGS. 8-9, the firearm projectile also may include a base 232, which may define a trailing end 242 of the firearm projectile. As illustrated in FIG. 8, firearm projectiles 90 further may include a shank 228, a heel 238 and a tail 230, such as a boat-tail 230. Boat-tail 230 may taper, step-in, or otherwise transition from shank 228 to base 232 such that a diameter of the base is less than a diameter of the shank.

Firearm projectiles that include hollow-point 98 may be referred to herein as a hollow-point firearm projectile. Firearm projectiles that include boat-tail 230 may be referred to herein as a boat-tail firearm projectile. Firearm projectiles that include both hollow-point 98 and boat-tail 230 may be referred to herein as boat-tail hollow-point firearm projectiles. Firearm projectiles that taper, or that decrease in diameter, from caliber diameter 226 toward both point 220 and base 232 may be referred to herein as double-tapered firearm projectiles.

Turning now to FIG. 9, in addition to firearm projectiles 90, firearm cartridges 200 may include a casing 204 that may define a head portion 212 and a mouth 214. Head portion 212 may be configured to receive an ignition device 208, such as a primer. Mouth 214 may be configured to receive a charge of a propellant 206, and firearm projectiles 90 may be seated within the mouth region. Subsequently, a firing pin of a firearm may strike ignition device 208, thereby igniting ignition device 208 which ignites propellant 206. Ignition of the propellant may provide a motive force for separation of firearm projectile 90 from casing 204 and/or may propel the firearm projectile from the firearm.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

Illustrative, non-exclusive examples of die assemblies, methods, and firearm projectiles according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A die assembly for forming a firearm projectile via compression of a metallic powder, the die assembly comprising:

a forming die defining a first side, a second side that is opposed to the first side, and a die cavity that extends between the first side and the second side;

a first punch configured to seal against the forming die from the first side; and a second punch configured to be received within the die cavity from the second side;

wherein, when the first punch seals against the forming die and the second punch is received within the die cavity, or the first punch is sealed against the forming die and the second punch is received within the die cavity such that, the first punch, the second punch, and the forming die collectively define a forming surface shaped to define an external contour of the firearm projectile;

wherein the forming die defines a die region of the forming surface;

wherein the first punch defines a first region of the forming surface; and wherein the second punch defines a second region of the forming surface.

A2. The die assembly of paragraph A1, wherein the first region of the forming surface is at least partially defined by a forming cavity that extends within the first punch.

A3. The die assembly of paragraph A2, wherein a transverse cross-sectional area of the forming cavity decreases as the forming cavity extends into the first punch.

A4. The die assembly of any of paragraphs A1-A3, wherein a first punch transverse cross-sectional area that is bounded by an outer perimeter of a transverse cross-section of a portion of the first punch that defines the first region of the forming surface is greater than a forming cavity transverse cross-sectional area that is defined by an outer perimeter of the first region of the forming surface that extends within the transverse cross-section.

A5. The die assembly of any of paragraphs A1-A4, wherein a first maximum dimension of a transverse cross-section of a/the portion of the first punch that defines the first region of the forming surface is greater than a second maximum dimension of a transverse cross-section of a portion of the second punch that defines the second region of the forming surface.

A6. The die assembly of any of paragraphs A1-A5, wherein the die cavity defines a first receiving region configured to receive the first punch, wherein a transverse cross-sectional area of the first receiving region is greater than a maximum transverse cross-sectional area of the forming surface.

A7. The die assembly of paragraph A6, wherein the first receiving region is a cylindrical, or an at least substantially cylindrical, first receiving region.

A8. The die assembly of any of paragraphs A1-A7, wherein the forming die defines a die sealing surface configured to seal against the first punch, wherein the die sealing surface extends radially outward from the forming surface.

A9. The die assembly of paragraph A8, wherein the die sealing surface at least one of:

(i) extends at a skew angle relative to a longitudinal axis of the forming die;

(ii) extends perpendicular to the longitudinal axis of the forming die; and (iii) extends at least substantially at a 45 degree angle relative to the longitudinal axis of the forming die.

A10. The die assembly of any of paragraphs A8-A9, wherein a maximum transverse cross-sectional dimension of the die sealing surface is greater than a maximum transverse cross-sectional dimension of the forming surface.

A11. The die assembly of any of paragraphs A1-A10, wherein at least one of:

(i) the first punch is external to the die cavity when the first punch seals against the forming die; and (ii) the first punch extends at least partially within the die cavity when the first punch seals against the forming die.

A12. The die assembly of any of paragraphs A1-A11, wherein the first punch defines a first punch sealing surface configured to seal against the forming die, wherein the first punch sealing surface extends radially outward from the forming surface.

A13. The die assembly of paragraph A12, wherein the first punch sealing surface at least one of:

(i) extends at a skew angle relative to a longitudinal axis of the first punch;

(ii) extends perpendicular to the longitudinal axis of the first punch; and (iii) extends at least substantially at a 45 degree angle relative to the longitudinal axis of the first punch.

A14. The die assembly of any of paragraphs A12-A13, wherein a maximum transverse cross-sectional dimension of the first punch sealing surface is greater than a/the maximum transverse cross-sectional dimension of the forming surface.

A15. The die assembly of any of paragraphs A1-A14, wherein the forming surface is at least partially cylindrical.

A16. The die assembly of any of paragraphs A1-A15, wherein a, and optionally every, transverse cross-section of the forming surface is circular, or at least substantially circular.

A17. The die assembly of any of paragraphs A1-A16, wherein the forming surface is shaped to define an external contour of at least one of:

(i) a boat-tail firearm projectile; and (ii) a hollow-point firearm projectile.

A18. The die assembly of any of paragraphs A1-A17, wherein the die region of the forming surface defines a central portion of the forming surface that defines a maximum transverse cross-sectional dimension of the forming surface, wherein the forming surface tapers away from the central portion of the forming surface toward the first punch and also toward the second punch.

A19. The die assembly of any of paragraphs A1-A18, wherein the die region of the forming surface that is defined by the forming die at least partially defines an external contour of a boat-tail firearm projectile.

A20. The die assembly of any of paragraphs A1-A19, wherein the die region of the forming surface that is defined by the forming die is at least partially tapered.

A21. The die assembly of any of paragraphs A1-A20, wherein the first region of the forming surface that is defined by the first punch at least partially defines an external contour of a point of a hollow-point firearm projectile.

A22. The die assembly of any of paragraphs A1-A21, wherein the second region of the forming surface that is defined by the second punch is at least one of:

(i) planar;

(ii) at least substantially planar;

(iii) arcuate;

(iv) curved;

(v) cupped;

(vi) concave;

(vii) convex; and (viii) symmetrical about a longitudinal axis of the die cavity.

A23. The die assembly of any of paragraphs A1-A22, wherein the forming die is at least one of:

(i) a rigid, or an at least substantially rigid, forming die; and (ii) a metallic forming die.

A24. The die assembly of any of paragraphs A1-A23, wherein the die cavity is an at least partially cylindrical die cavity.

A25. The die assembly of any of paragraphs A1-A24, wherein the die cavity is shaped to slidingly receive the second punch along a/the longitudinal axis of the die cavity.

A26. The die assembly of any of paragraphs A1-A25, wherein the first punch is at least one of:

(i) a rigid, or an at least substantially rigid, first punch; and (ii) a metallic first punch.

A27. The die assembly of any of paragraphs A1-A26, wherein the first punch is an at least partially cylindrical first punch.

A28. The die assembly of any of paragraphs A1-A27, wherein the forming die is at least one of:

(i) a rigid, or an at least substantially rigid, forming die; and (ii) a metallic forming die.

A29. The die assembly of any of paragraphs A1-A28, wherein the second punch is an at least partially cylindrical second punch.

B1. A method of forming a firearm projectile utilizing the die assembly of any of paragraphs A1-A29, the method comprising:

positioning the second punch within a region of the die cavity from the second side of the forming die;

metering a volume of metallic powder into a remainder of the die cavity;

sealing the first punch against the forming die from the first side of the forming die; and extending the second punch into the die cavity to compress the metallic powder and form the firearm projectile within the forming surface of the die assembly.

B2. The method of paragraph B1, wherein the positioning includes slidingly translating the second punch along a portion of a longitudinal axis of the die cavity.

B3. The method of any of paragraphs B1-B2, wherein the metering includes metering a predetermined mass of the metallic powder into the remainder of the die cavity.

B4. The method of any of paragraphs B1-B3, wherein the metering includes filling the remainder of the die cavity with the metallic powder and partially retracting the second punch from the die cavity such that the die cavity defines an empty cavity region, a powder-filled cavity region, and a second punch-filled cavity region, wherein the sealing includes positioning the first punch within the empty cavity region.

B5. The method of any of paragraphs B1-B4, wherein the sealing includes engaging a/the die sealing surface of the forming die with a/the first punch sealing surface of the first punch.

B6. The method of any of paragraphs B1-B5, wherein the sealing includes directly applying a sealing load between the first punch and the forming die.

B7. The method of paragraph B6, wherein the sealing load is directed along a/the longitudinal axis of the first punch.

B8. The method of any of paragraphs B1-B7, wherein the sealing includes sealing without placing the first punch within the die cavity.

B9. The method of any of paragraphs B1-B8, wherein the extending includes applying at least a threshold pressure to the metallic powder, optionally wherein the threshold pressure is at least 100 megapascals, at least 200 megapascals, at least 300 megapascals, at least 400 megapascals, at least 500 megapascals, at least 600 megapascals, at least 700 megapascals, at least 800 megapascals, or at least 900 megapascals.

B10. The method of any of paragraphs B1-B9, wherein the method includes forming the firearm projectile with a single extension of the second punch.

B11. The method of any of paragraphs B1-B10, wherein the extending includes slidingly extending the second punch into the die cavity.

B12. The method of any of paragraphs B1-B11, wherein the extending includes slidingly receiving the second punch within the die cavity.

B13. The method of any of paragraphs B1-B12, wherein the extending includes extending along a longitudinal axis of the second punch.

B14. The method of paragraph B13, wherein the extending includes extending without directly applying an extending load, which is directed along the longitudinal axis of the second punch, between the second punch and the forming die.

B15. The method of any of paragraphs B1-B14, wherein, subsequent to the extending, the method further includes:

retracting the second punch from the die cavity;

separating the first punch from the forming die; and removing the firearm projectile from the die cavity.

B16. The method of any of paragraphs B1-B15, wherein the method further includes ejecting the firearm projectile from the die cavity utilizing the second punch.

C1. A firearm projectile formed utilizing the method of any of paragraphs B1-B16.

C2. The firearm projectile of paragraph C1, wherein the firearm projectile includes a double-tapered firearm projectile.

C3. The firearm projectile of any of paragraphs C1-C2, wherein the firearm projectile includes a hollow-point firearm projectile.

C4. The firearm projectile of any of paragraphs C1-C3, wherein the firearm projectile includes a boat-tail firearm projectile.

C5. The firearm projectile of any of paragraphs C1-C4, wherein the firearm projectile includes a boat-tail hollow-point firearm projectile.

D1. The use of a die assembly that includes a forming die, a first punch, and a second punch to form a firearm projectile.

D2. The use of any of the methods of any of paragraphs B1-B16 to form a firearm projectile.

D3. The use of any of paragraphs D1-D2, wherein the first punch seals against the forming die.

D4. The use of any of paragraphs D1-D3, wherein the second punch is slidingly received within a die cavity of the forming die.

D5. The use of any of paragraphs D1-D4, wherein the firearm projectile includes a double-tapered firearm projectile.

D6. The use of any of paragraphs D1-D5, wherein the firearm projectile includes a hollow-point firearm projectile.

D7. The use of any of paragraphs D1-D6, wherein the firearm projectile includes a boat-tail firearm projectile.

D8. The use of any of paragraphs D1-D7, wherein the firearm projectile includes a boat-tail hollow-point firearm projectile.

INDUSTRIAL APPLICABILITY

The die assemblies, methods, and firearm projectiles disclosed herein are applicable to the metal forming and firearm projectile industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A die assembly for forming a firearm projectile via compression of a metallic powder, the die assembly comprising:

a forming die defining a first side, a second side that is opposed to the first side, and a die cavity that extends between the first side and the second side;

a first punch configured to seal against the forming die from the first side; and a second punch configured to be received within the die cavity from the second side;

wherein, when the first punch seals against the forming die and the second punch is received within the die cavity, the first punch, the second punch, and the forming die collectively define a forming surface shaped to define an external contour of the firearm projectile;

wherein the forming die defines a die region of the forming surface;

wherein the first punch defines a first region of the forming surface;

wherein the second punch defines a second region of the forming surface;

wherein the forming surface defines a die cavity configured to receive the metallic powder;

wherein the second punch is configured to extend into the die cavity to press against the metallic powder to form the firearm projectile;

wherein the forming surface is shaped to define a hollow-point, boat-tail firearm projectile; and wherein the die region of the forming surface that is defined by the forming die at least partially defines an external contour of a boat-tail of the hollow-point, boat-tail firearm projectile.

2. The die assembly of claim 1, wherein the first region of the forming surface that is defined by the first punch at least partially defines an external contour of a hollow-point of the hollow-point, boat-tail firearm projectile.

3. The die assembly of claim 1, wherein the die region of the forming surface defines a central portion of the forming surface that defines a maximum transverse cross-sectional dimension of the forming surface, wherein the forming surface tapers away from the central portion of the forming surface toward the first punch and also toward the second punch.

4. A method of forming a firearm projectile utilizing the die assembly of claim 1, the method comprising:

positioning the second punch within a region of the die cavity from the second side of the forming die;

metering a volume of metallic powder into a remainder of the die cavity;

sealing the first punch against the forming die from the first side of the forming die; and extending the second punch into the die cavity to compress the metallic powder and form the firearm projectile within the forming surface of the die assembly.

5. A hollow-point, boat-tail firearm projectile formed by the method of claim 4.

6. A die assembly for forming a firearm projectile via compression of a metallic powder, the die assembly comprising:

a forming die defining a first side, a second side that is opposed to the first side, and a die cavity that extends between the first side and the second side;

a first punch configured to seal against the forming die from the first side; and a second punch configured to be received within the die cavity from the second side;

wherein, when the first punch seals against the forming die and the second punch is received within the die cavity, the first punch, the second punch, and the forming die collectively define a forming surface shaped to define an external contour of the firearm projectile;

wherein the forming surface defines a die cavity configured to receive the metallic powder;

wherein the forming die defines a die region of the forming surface;

wherein the first punch defines a first region of the forming surface and a first punch sealing surface configured to seal against the forming die, wherein the first punch sealing surface extends radially outward from the forming surface;

wherein the second punch is configured to extend into the die cavity to press against the metallic powder to form the firearm projectile;

wherein the second punch defines a second region of the forming surface; and wherein the die region of the forming surface that is defined by the forming die at least partially defines an external contour of a boat-tail of the firearm projectile.

7. The die assembly of claim 6, wherein the first region of the forming surface is at least partially defined by a forming cavity that extends within the first punch.

8. The die assembly of claim 7, wherein a transverse cross-sectional area of the forming cavity decreases as the forming cavity extends into the first punch.

9. The die assembly of claim 6, wherein a first punch transverse cross-sectional area that is bounded by an outer perimeter of a transverse cross-section of a portion of the first punch that defines the first region of the forming surface is greater than a forming cavity transverse cross-sectional area that is defined by an outer perimeter of the first region of the forming surface that extends within the transverse cross-section.

10. The die assembly of claim 6, wherein a first maximum dimension of a transverse cross-section of a portion of the first punch that defines the first region of the forming surface is greater than a second maximum dimension of a transverse cross-section of a portion of the second punch that defines the second region of the forming surface.

11. The die assembly of claim 6, wherein the die cavity defines a first receiving region configured to receive the first punch, wherein a transverse cross-sectional area of the first receiving region is greater than a maximum transverse cross-sectional area of the forming surface.

12. The die assembly of claim 6, wherein the forming die defines a die sealing surface configured to seal against the first punch, wherein the die sealing surface extends radially outward from the forming surface.

13. The die assembly of claim 6, wherein every transverse cross-section of the forming surface is at least substantially circular.

14. The die assembly of claim 6, wherein the die region of the forming surface defines a central portion of the forming surface that defines a maximum transverse cross-sectional dimension of the forming surface, wherein the forming surface tapers away from the central portion of the forming surface toward the first punch and also toward the second punch.

15. The die assembly of claim 6, wherein the die region of the forming surface that is defined by the forming die at least partially defines an external contour of a hollow-point firearm projectile.

16. The die assembly of claim 6, wherein the die region of the forming surface that is defined by the forming die is at least partially tapered.

17. The die assembly of claim 6, wherein the first region of the forming surface that is defined by the first punch at least partially defines an external contour of a hollow-point of a hollow-point firearm projectile.

18. The die assembly of claim 6, wherein the die cavity is shaped to slidingly receive the second punch along a longitudinal axis of the die cavity.

19. A method of forming a firearm projectile utilizing the die assembly of claim 6, the method comprising:

positioning the second punch within a region of the die cavity from the second side of the forming die;

metering a volume of metallic powder into a remainder of the die cavity;

sealing the first punch against the forming die from the first side of the forming die; and extending the second punch into the die cavity to compress the metallic powder and form the firearm projectile within the forming surface of the die assembly.

20. The method of claim 19, wherein the sealing includes engaging a die sealing surface of the forming die with a first punch sealing surface of the first punch.

21. The method of claim 19, wherein the sealing includes directly applying a sealing load between the first punch and the forming die.

22. The method of claim 19, wherein the extending includes extending along a longitudinal axis of the second punch without directly applying an extending load, which is directed along the longitudinal axis of the second punch, between the second punch and the forming die.

23. A firearm projectile formed by the method of claim 19.

24. The die assembly of claim 1, wherein the forming die is a unitary forming die.

25. The die assembly of claim 6, wherein the forming die is a unitary forming die.

26. The method of claim 4, wherein the method includes maintaining a fixed location of the forming die and of the first punch during the extending.

27. The method of claim 19, wherein the method includes maintaining a fixed location of the forming die and of the first punch during the extending.

* * * * *